United States Patent [19]

Beachum

[11] Patent Number: 4,583,458

[45] Date of Patent: Apr. 22, 1986

[54] MULTI-STATION SILK SCREEN PRINTER FOR PRINTING VARYING INDICIA

[76] Inventor: Gary T. Beachum, 8228 Savage Guilford Rd., Savage, Md. 20763

[21] Appl. No.: 714,969

[22] Filed: Mar. 22, 1985

[51] Int. Cl.[4] ..... B41F 15/04; B41F 15/10; B41F 15/36

[52] U.S. Cl. ..... 101/126; 101/112; 101/115; 101/407 BP

[58] Field of Search ..... 101/126, 123, 115, 112, 101/407 BP

[56] References Cited

U.S. PATENT DOCUMENTS

| | | | |
|---|---|---|---|
| 2,153,435 | 4/1939 | Schneider et al. | 101/115 |
| 2,540,326 | 2/1951 | Farwell | 101/126 |
| 2,613,595 | 10/1952 | Weldon | 101/126 X |
| 3,244,093 | 4/1966 | Vasilantone | 101/407 BP X |
| 3,427,964 | 2/1969 | Vasilantone | 101/126 X |
| 3,486,441 | 12/1969 | Hillman et al. | 101/126 X |
| 4,084,504 | 4/1978 | Fuchs | 101/126 X |
| 4,099,460 | 7/1978 | Bubley et al. | 101/126 X |

*Primary Examiner*—Clifford D. Crowder

*Attorney, Agent, or Firm*—Morton J. Rosenberg

[57] ABSTRACT

A silk screen printing system (10) is provided which allows the user to print indicia (12) on articles (14). The printing system (10) includes a longitudinally extending printing frame (20) which is mounted on a base surface (22). A plurality of work stations (88) are mounted to the printing system frame (20) and rotatable about a vertical axis (40) to allow displacement of printing stations (88) from a first position to various subsequent printing positions. Articles (14) are mounted on the printing stations (88) and are contacted by an indicia printing carriage mechanism (32) which carries a stencil member (18) for imprinting pigmentation of particular indicia (12) on various articles (14). The indicia printing carriage mechanism (32) is displaceable in a longitudinal direction (16) to allow indexing and registration of indicia (12) on various articles (14) at the discretion of the user. Additionally, the articles (14) may be rotated from one position to another to allow loading, printing, drying and any other operations to be performed on a multiplicity of articles (14) substantially in a simultaneous manner.

18 Claims, 7 Drawing Figures

10
12
14
16
18
20
34
38
62
66
70
88
96
100
102
104
106
118
162
7

FIG. 2
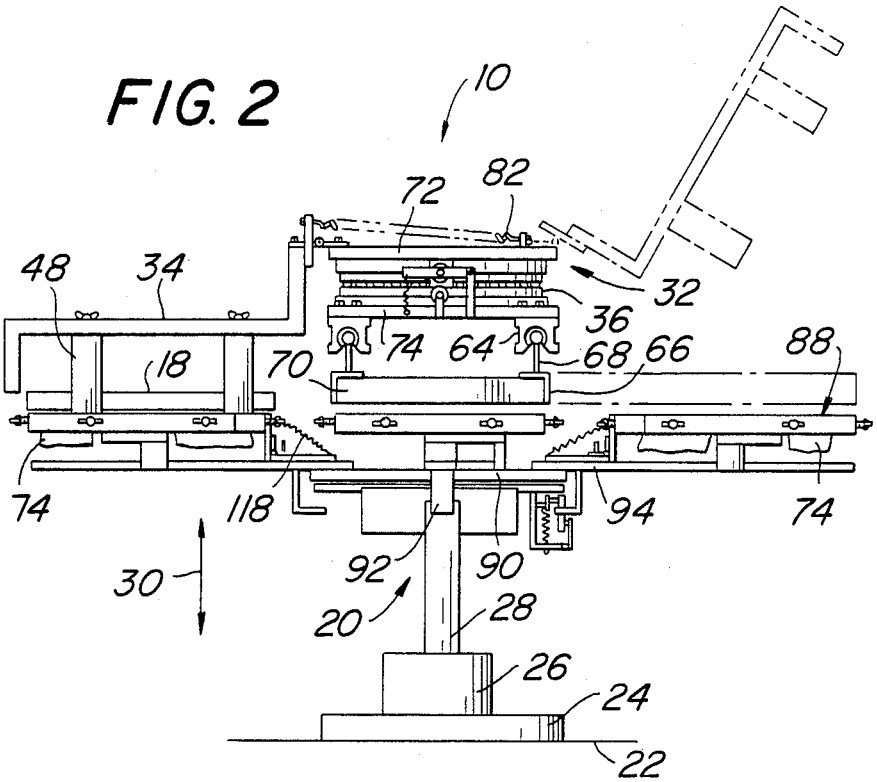
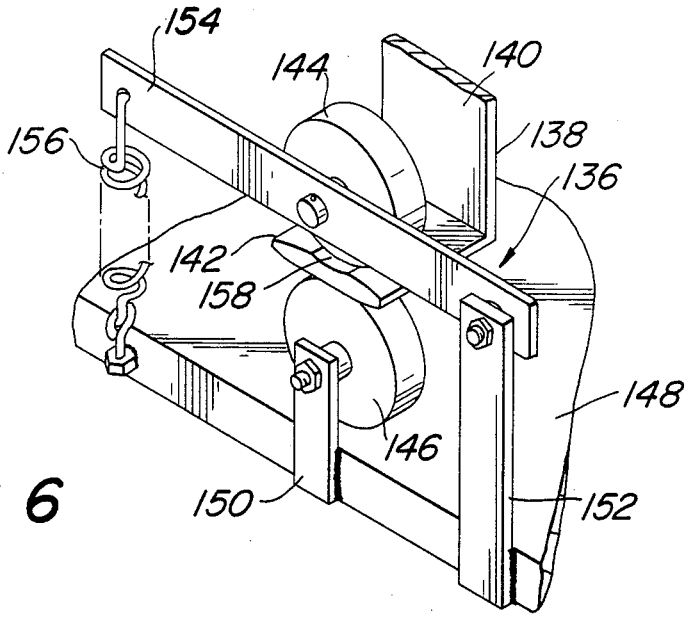
FIG. 6

MULTI-STATION SILK SCREEN PRINTER FOR PRINTING VARYING INDICIA

BACKGROUND OF THE INVENTION

1. Field of the Invention

This invention relates to printing system mechanisms. In particular, this invention directs itself to silk screen printing systems for printing varying indicia on a plurality of articles. More in particular, this invention to a printing system which includes a printing frame having rotatably mounted thereto a plurality of work station mechanisms upon which the articles to be printed are mounted. More in particular, this invention relates to a silk screen printing system wherein the articles mounted on varying work stations may be rotated with respect to a stabilized printing frame to allow the articles to be successively rotatably displaced from a loading position to a printing position and then to a drying position. Additionally, this invention relates to a silk screen printing system which includes an indicia printing carriage mechanism for contacting the articles mounted on work stations by an indicia bearing stencil member. Further, this invention directs itself to a silk screen printing system which includes the indicia printing carriage mechanism displaceable in a longitudinal direction to allow indexing of the indicia on the articles to be printed. More in particular, this invention provides for the printing stations carrying the articles to be rotated about a secondary axis to allow orientation of the indicia at predetermined points on the articles to be printed.

2. Prior Art

Silk screen printing systems are well-known in the art. The best prior art known to the Applicant includes U.S. Pat. Nos. 3,992,989; 4,084,504; 3,166,011; 3,795,189; 2,613,595; 4,031,825; 3,838,639; 3,842,733; 2,057,950; 2,183,223; 4,404,903; 4,407,195; 3,650,207; and, 2,963,964.

In some prior art printing systems, there is provided various modes and mechanisms for displacing the articles to be printed. However, in some prior art systems, there are not provided a plurality of work stations which hold the articles to be printed and are rotatable from one station position to a next station position. Additionally, some prior art systems do not provide for a rotatable set of work stations with respect to a base frame to allow displacement of the work stations and the articles to be printed.

In other prior art systems, there is not provided the system mechanisms which allow rotation of the articles to be printed about a plurality of vertically directed axes in order to allow orientation of indicia to be printed at varying angles on the articles. Still further in other prior art systems, there is not provided a longitudinally displaceable indicia printing carriage mechanism which allows for indexing of various indicia at predetermined points or locations on an article to be printed. Still further, other prior art systems do not allow for the indicia printing carriage mechanisms to be rotatable in a horizontal plane to allow printing at two or more work stations.

In some prior art systems, there is not provided a work station placement zone above a drying mechanism to minimize the time for drying the articles which have been printed.

SUMMARY OF THE INVENTION

A silk screen printing system for printing indicia on articles which includes a longitudinally extending printing frame mounted on a base surface. An indicia printing carriage mechanism applies indicia to the articles with the indicia printing carriage mechanism being coupled to the printing frame and being linearly displaceable in a longitudinal direction. The printing system includes a plurality of printing station mechanisms having the articles mounted thereon. The printing station mechanisms are contacted by the indicia carriage mechanism for printing the indicia on the articles.

BRIEF DESCRIPTION OF THE DRAWINGS

FIG. 2 is an elevational view of the printing system;

FIG. 6 is a perspective view of the mechanism for orienting the work stations and maintaining such in a predetermined rotational position; and, FIG. 7 is a sectional view of the stencil member and a portion of the printing station carriage frame taken along the Section Line 7—7 of FIG. 1.

DESCRIPTION OF THE PREFERRED EMBODIMENTS

Figure 1:
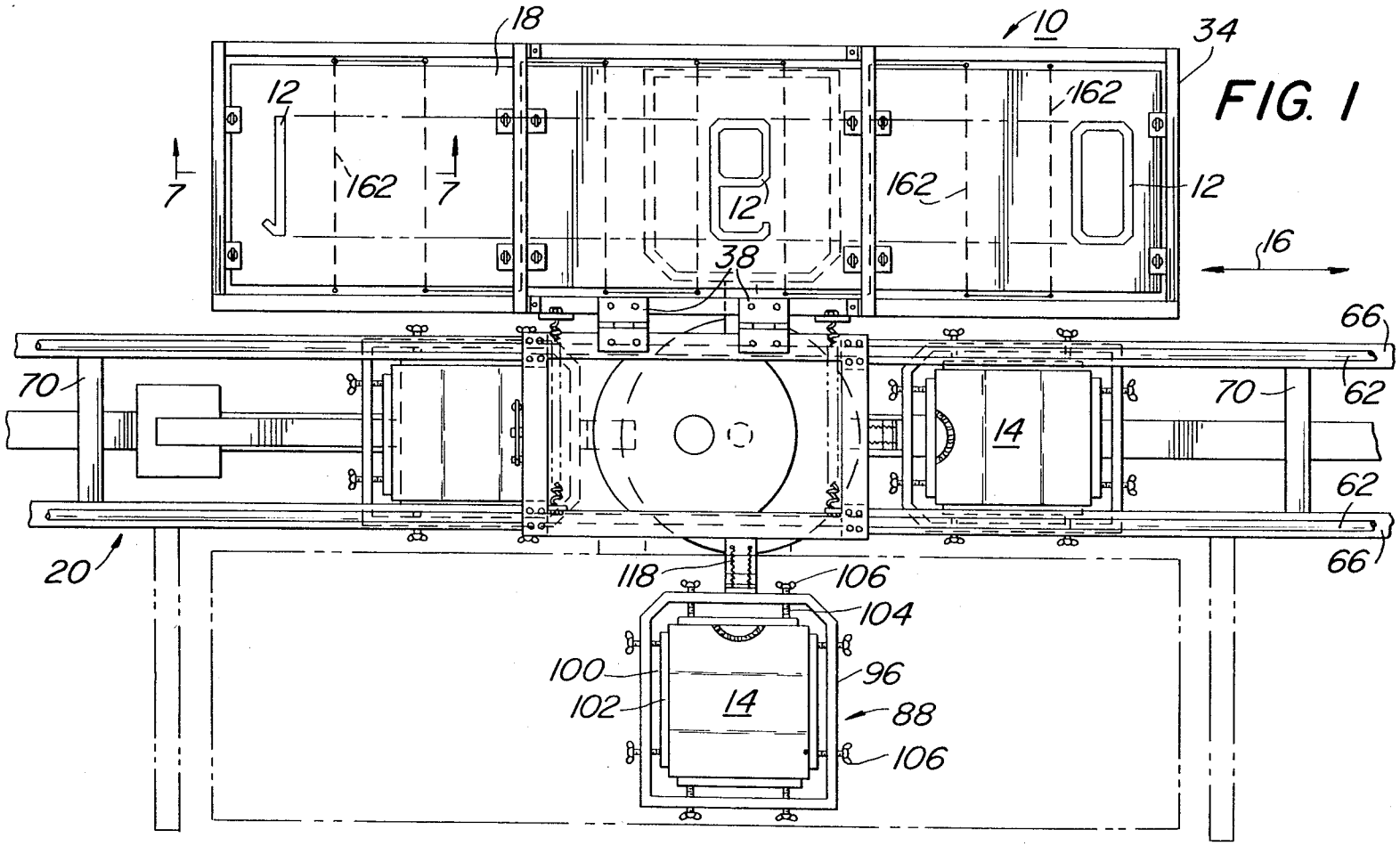
FIG. 1 is a plan view of the printing system.
Figure 3:
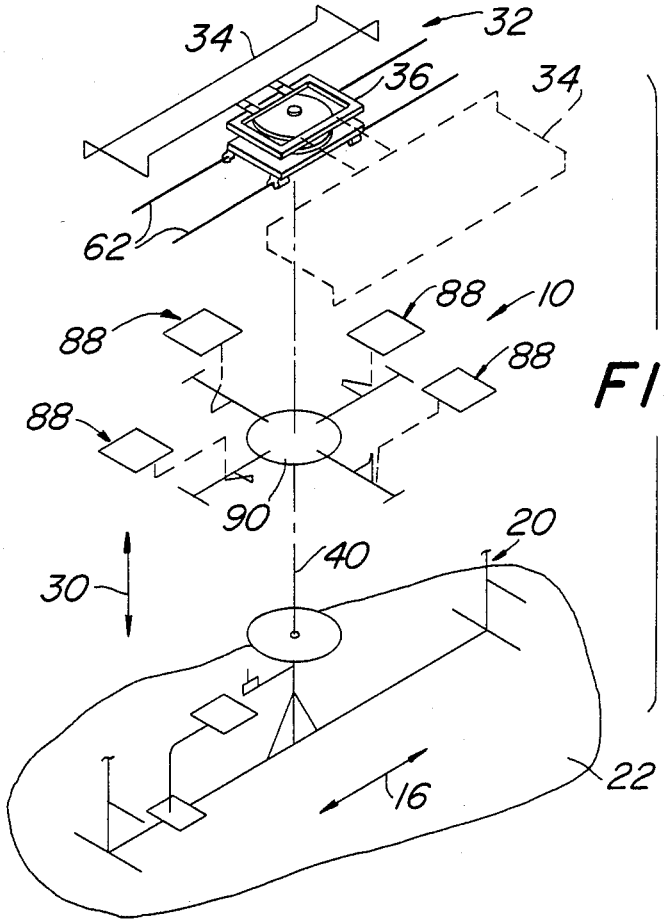
FIG. 3 is a schematic representation of the printing system showing rotational axes and displacement mechanisms.

Referring now to FIGS. 1, 2 and 3, there is shown printing system 10 for printing various indicia 12 on articles 14. It is to be understood that references to indicia 12 include any and all designs, letters, and/or numbers. It is to be further understood that reference to articles 14 may include articles of clothing, other articles formed of textiles, paper, fabric, plastic or any other articles conducive to application of indicia or designs 12 thereon. Printing system 10 as herein described is particularly adapted for silk screen printing procedures when printing plate or stencil member 18 carrying various indicia 12 is used for the printing process. Additionally, and in the case of a silk screening procedure, indicia 12 as shown in FIG. 1 are provided on printing plate or stencil member 18. Stencil member 18 is contacted on an upper surface thereof with a pigmentation composition such as ink, paint, or some like pigmentation composition and indicia 12 is transferred to a predetermined location on article 14 by contacting articles 14 with stencil member 18 on a lower surface thereof in the usual step procedures of silk screening, wherein the operator will rollingly engage the upper surface of stencil member 18 with a rolling contact force. Stencil member 18 will be more fully developed in following paragraphs.

In overall concept, printing system 10 provides for a printing mechanism whereby articles 14 and associated indicia 12 may be indexed each with respect to the other. Indexing of printing system 10 allows for a plurality of indicia 12 to be easily printed on an article 14 in a plurality of positional locations. Additionally, printing system 10 allows for a multiplicity of operations to be maintained during simultaneous time intervals. Thus, as will be shown in following paragraphs, articles 14 may be loaded or mounted on printing system 10 while the printing process is being accomplished in a substantially simultaneous time interval. Still further, another article 14 may be being dried during this same time interval. Thus, printing system 10 as herein described provides for an increased speed of operation of the overall printing process by allowing a plurality of operations to be accomplished during a particular time interval. Additionally, such printing system 10 allows the user the added flexibility of applying indicia 12 at indexed locations on articles 14 at a plurality of positional alignments desired by the user.

Printing system 10 is used for printing indicia 12 on articles 14. Printing system 10 includes printing frame 20 extending in longitudinal direction 16. Printing frame 20 is mounted on base surface 22 as is shown in the schematic diagram of FIG. 3. Although not important to the inventive concept as herein described, printing system 10 may include first base member 24 in contiguous contact with base surface 22. Additionally, second base member 26 secured to first base member 24 is provided to provide fixed constrainment therebetween and give printing system 10 a stabilized base system. Central shaft member 28 extends in vertical direction 30 and as will be seen, provides for a rotational axis to be further described in following paragraphs. The particular base member system for mounting printing system 10 to base surface 22 is not important to the inventive concept as herein described, with the exception that such should provide for a stabilized structural mounting system to allow the printing procedure.

Figure 4:
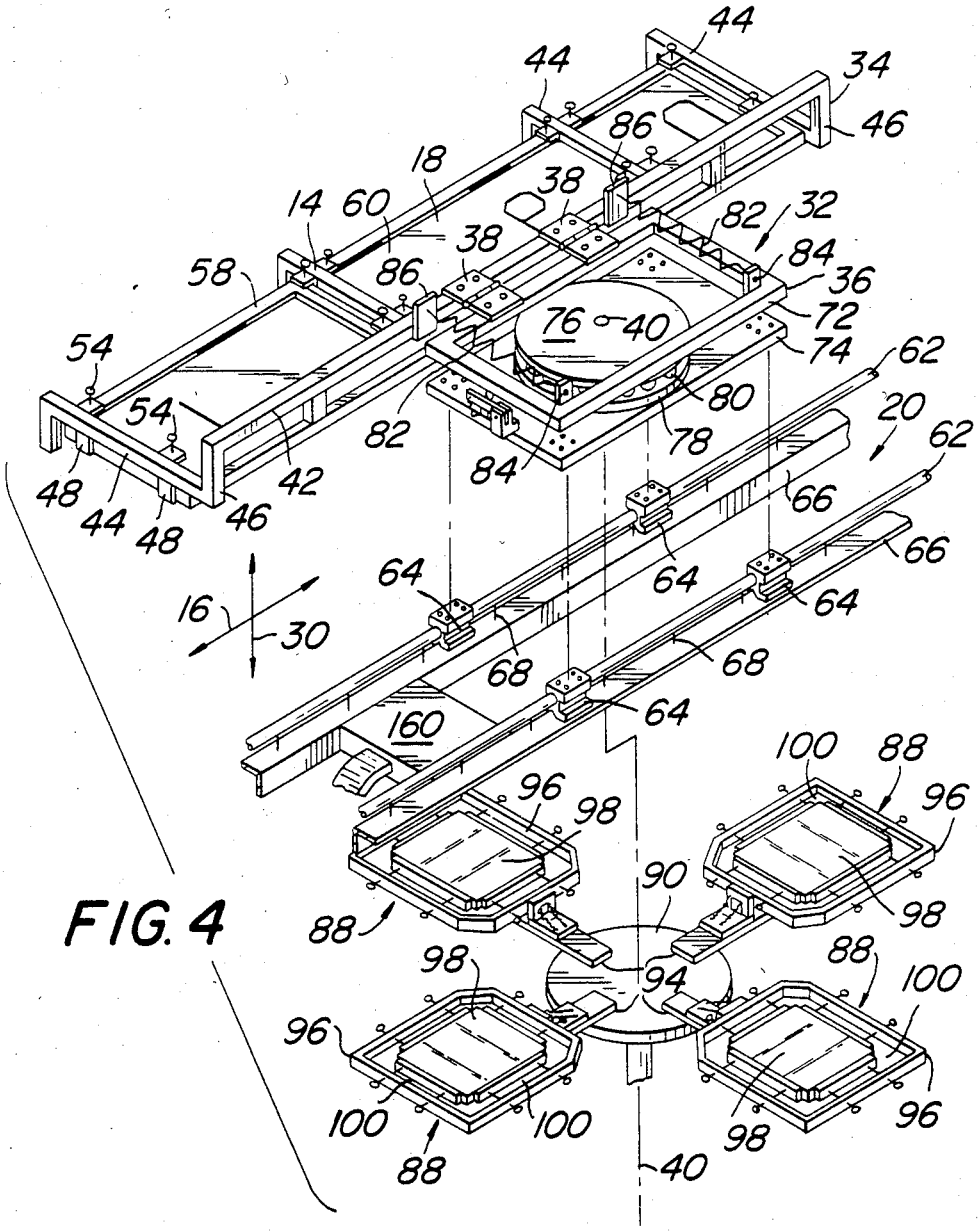
FIG. 4 is an exploded perspective cut-away view showing the indicia printing carriage mechanism in combination with the printing station mechanisms.

Printing system 10 includes indicia printing carriage mechanism 32 shown in FIGS. 2, 4 and 3. Indicia printing carriage mechanism 32 is used for applying indicia 12 to articles 14. As will be seen, indicia printing carriage mechanism 32 is coupled to printing frame 20 in a manner to allow linear displacement of indicia printing carriage mechanism 32 in longitudinal direction 16 with respect to stabilized printing frame 20.

Indicia printing carriage mechanism 32 includes indicia carriage frame 34 extending in longitudinal direction 16 for capturing and holding at least one stencil or printing plate member 18. Additionally, indicia printing carriage mechanism 32 includes indicia carriage bearing frame 36 which is coupled to indicia carriage frame 34 by hinge members 38 which allows indicia carriage frame 34 to be rotatable about a longitudinal axis parallel to direction 16. Additionally, indicia carriage bearing frame 36 in combination with indicia carriage frame 34, is rotatable about first vertical axis 40 shown in the schematic diagram provided in FIG. 3 and shown in FIG. 4. In this manner, indicia carriage frame 34 may be rotated in a reversible manner from opposing transverse sides of printing system 10 as is shown by the phantom line drawings of FIG. 3.

Figure 7:
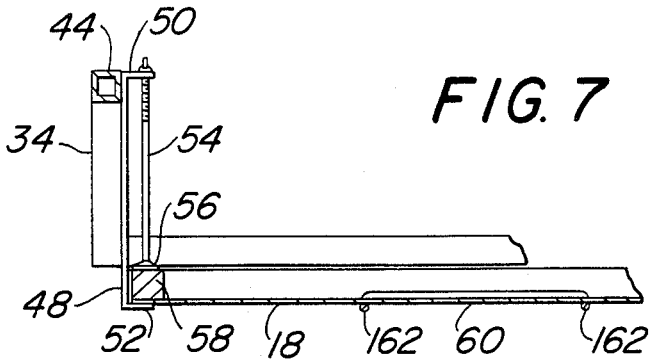

Indicia carriage frame 34 shown in FIGS. 4, 2 and 1 includes longitudinally extending carriage frame bar members 42 which are rigidly secured to carriage frame transverse bar members 44. Securement may either be maintained by one piece formation or welding, threaded securement, or some like coupling, not important to the inventive concept. As can be seen, carriage frame longitudinal bar members 42 are generally vertically displaced from carriage frame transverse bar members 44 by intervening vertically directed carriage frame bar members 46. Angle iron members 48, more clearly seen in FIG. 7, may be mounted to carriage frame transverse bar members 44 by welding or some like fixed securement mechanism. Angle iron bar members 48 are generally U-shaped in contour and as can be seen in FIG. 7, stencil or plate member 18 is captured between opposing angle iron bar member legs 50 and 52 by threaded bolt member 54 having a base 56 which captures stencil 18 between base 56 of threaded bolt 54 and lower leg member 52 of angle iron member 48.

Printing plate or stencil member 18 is formed of stencil frame member 58 formed in a closed contour and adapted for insert within carriage frame longitudinal bar members 42 and transverse bar members 44 as is shown in FIGS. 4 and 1. Central transverse bar members 44 are releasably securable to carriage frame 34 to allow insert of differing sized screens or stencils 18. Attached to stencil member bars 58 is stencil fabric member 60 containing the outline of indicia 12. Stencil fabric member 60 may be formed of textile-like fabric or plastic material which is well-known in the art. Stencil fabric member 60 may be mounted to stencil bar members 58 by stapling, adhesive attachment, or some like fixed technique. In this manner, stencil member 18 may be inserted within the open contour defining indicia carriage frame 34 as is shown in the Figures. Additionally, as can now be clearly understood from FIG. 7, threaded bolt 54 may be placed into releasable force contact with stencil member bar members 58 as is shown in order to maintain stencil member 18 in fixed securement with respect to indicia carriage frame 34. Thus, stencil member 18 is inserted within the open framework of indicia carriage frame 34 and stencil member bars 58 are contiguously mounted against lower angle iron member legs 52. Threaded bolt 54 is threaded through upper angle iron member leg 50 until threaded bolt base member 56 contacts an upper surface of stencil member bar members 58 to hold stencil member 18 in place during a printing process. Subsequent to a printing process, stencil member or printing plate 18 may be removed from indicia carriage frame 34 for insert therein of a new stencil member 18 carrying differing indicia 12.

Printing system 10 and in particular, printing frame 20 includes a pair of transversely displaced track members 62 extending in longitudinal direction 16. Track members 62 slidingly engage a plurality of sliding bearing members 64 which are secured to indicia carriage bearing frame 36 to allow longitudinal displacement of indicia printing carriage mechanism 32 including both indicia carriage frame 34 and indicia carriage bearing frame 36 when taken with respect to printing system frame 20. Track members 62 are vertically displaced from respective longitudinally extending angle iron members 66 by a plurality of vertically extending rod members 68 as is shown in FIG. 4. Rod members 68 may be mounted on opposing ends to respective angle iron member 66 and track members 62 through welding or some like technique, not important to the inventive concept as herein defined, with the exception that the positional location of rod member 58 and angle iron members 66 allow for sliding movement of respective sliding bearing members 64 in longitudinal direction 16.

Angle iron members 66 are secured to cross member bars 70 through welding, bolting, or some like technique. Cross bar members 70 in themselves are then fixedly secured to printing frame 20 through bolting, welding, or some like technique, not important to the inventive concept as is herein described.

Optional removable support arms, shown in phantom line drawings in FIG. 1, may extend in a transverse direction from printing system 10. Such support arms may allow for attachment of a vacuum table or pallets for piece good printing.

As has been previously disclosed, indicia printing carriage mechanism 32 is formed of both indicia carriage frame 34 and indicia carriage bearing frame 36. Indicia carriage frame 34 is rotatively displaceable with respect to indicia carriage bearing frame 36 about a longitudinal axis defined by hinge members 38 shown clearly in FIGS. 1 and 4. Indicia carriage bearing frame mechanism 36 includes upper open contour indicia carriage bearing frame 72 and lower indicia carriage bearing frame 74, as is shown in FIG. 4. Upper open contour indicia carriage bearing frame 72 is displaced in vertical direction 30 from lower indicia carriage bearing frame 74. Lower indicia carriage bearing frame 74 may be a substantially planar plate member secured on corner ends to sliding bearing members 64 through bolting, or threaded securement type techniques.

Indicia carriage bearing frame mechanism 36 further includes upper indicia carriage bearing plate member 76 and lower indicia carriage bearing frame plate member 78, as is shown. Interspersed between upper plate 76 and lower plate 78 is a mechanism for rotatively actuating upper plate member 76 with respect to lower plate member 78 to allow indicia printing carriage mechanism 32 to be rotated about first vertical axis 40. The mechanism for rotatively actuating upper plate 76 with respect to lower plate 78 is through roller bearings 80 which may be mounted within respective circular channels formed in upper plate 76 and lower plate 78. In this manner, the entire indicia printing carriage mechanism 32 may be rotatively actuated.

Spring members 82 which may be standard coil type springs are mounted on opposing ends to lug members 84 coupled to indicia carriage bearing frame 36 and lug members 86 coupled to indicia carriage frame 34. Spring members 82 provide a biasing force to incline indicia printing carriage mechanism 32 with respect to indicia carriage bearing frame 36 which is maintained in a horizontal plane through attachment to printing frame 20. In this manner, the user must apply a force on indicia carriage frame 34 to place such in contact with articles 14 during the printing process. When the user releases the force loading, indicia carriage frame 34 automatically removes itself from articles 14 to permit movement of articles 14 to another location, as will be seen in following paragraphs.

Printing system 10 further includes a plurality of printing station mechanisms 88 adapted to have articles 14 mounted thereon. Printing station mechanisms 88 are contacted by indicia printing carriage mechanism 32 for printing indicia 12 on articles 14. Printing station mechanisms 88 are rotatably displaceable about first vertical axis 40 in a substantially horizontal plane.

Each printing station mechanism 88 is fixedly secured to central bearing member 90 which may be a disk member having central disk bearing 92 extending within central shaft member 28 in rotative displacement therewith to allow rotative displacement of printing station mechanisms 88.

Figure 5:
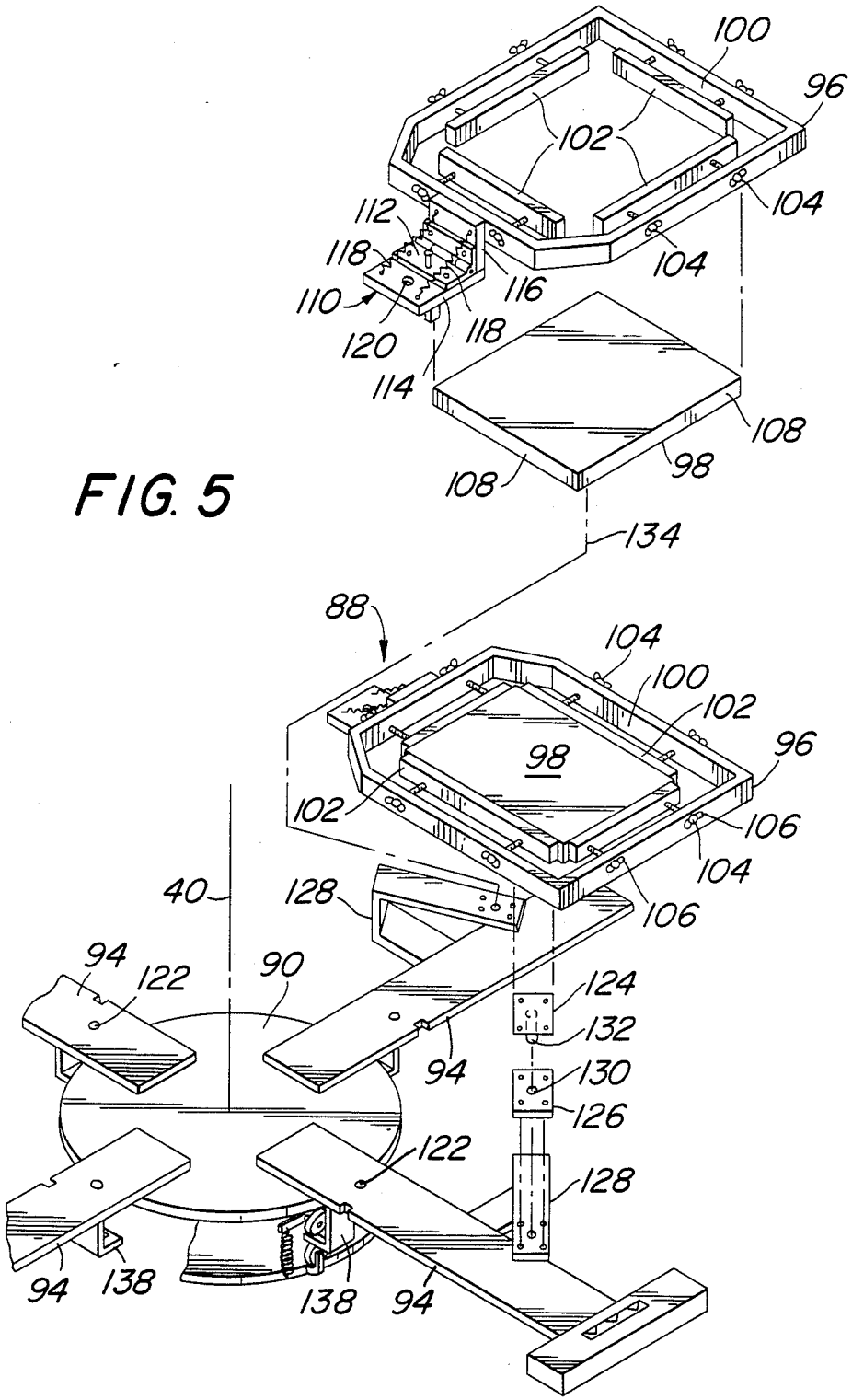
FIG. 5 is an exploded, perspective view partially in cut-away showing the printing work station mechanisms.

Each printing station mechanism 88 includes printing station bar member 94 fixedly secured to central bearing member 90 and extending in a radial direction when taken with respect to first vertical axis 40. As seen in FIG. 5, printing station bar members 94 are fixedly secured through welding, bolting, or some like technique to an upper surface of central bearing member 90. At the end of printing station bar member 94 a registration mechanism may be attached in order to provide register of numbers being printed on articles 14.

Each printing station mechanism 88 includes printing station frame 96 which is generally a closed contour substantially rectangular frame section, as is shown in FIG. 5. Additionally, each printing station mechanism 88 includes printing station base plate members 98 positionally located internal printing station frames 96. As is clearly seen in FIGS. 1 and 4 base plate members 98 may include a central raised printing area for locating indicia to be printed. Further, four printing station mechanisms 88 are shown, however, these are for illustrative purposes only and the number of mechanisms 88 may exceed four dependent upon the use and needs of the operator. Articles 14 are mounted on printing station base plate members 98 in a manner to be described in following paragraphs.

Printing station mechanisms 88 further include releasable securement mechanism 100 for securing articles 14 to printing station base plate members 98 and printing station frame 20. Releasable securement mechanism 100 includes frictional bar members 102 which are threadedly secured to printing station frame 96 for being displaced into force contact with printing station base plate member 98. Articles 14 are thus captured between frictional bar members 102 and printing station base plate 98 as is clearly seen in FIG. 5. Threaded bolts 104 extend through printing station frame section 96 as is shown, and are fixedly secured to frictional bar members 102. As wing nuts 106 are rotated, threaded bolts 104 are either linearly displaced internal to printing station frame 96, or are displaced in an outward manner with respect thereto. Printing station base plate members 98 are mounted in substantially planar relation to printing station frame 96 within the internal confines thereof and are contacted on side surfaces 108 by frictional bar members 102. Articles 14 are extended over the side surfaces or sidewalls 108 and are captured between sidewalls 108 of printing station base plate members 98 and frictional bar members 102.

As can be further seen in FIG. 5, printing station mechanisms 88 as well as printing station frames 96 are hingedly secured to printing system frame 20 to allow rotative displacement of printing station frame 96 with respect to printing station base plate member 98. Printing station hinge mechanism 110 includes printing station hinge 112 which rotatively couples first printing station lug members 114 to second printing station lug member 116. A pair of printing station coil springs 118 are coupled on opposing ends to first and second printing station lug members 114 and 116, as is shown. First printing station lug members 114 may be mounted to printing station bar members 94 through threaded openings 120 and cooperative openings 122 formed through bar members 94. In this manner, when frictional bar members 102 are released from printing station base plate members 98, printing station frame 96 is baised in an inclined direction to allow automative removal of printing station frame 96 from printing station base plate members 98.

Printing station base plate members 98 are further mounted to respective printing station bar members 94 in a rotative manner to allow printing station mechanism 88 to be located in a predetermined angular orientation with respect to printing station frame 20. Base plate securement member 128 shown in FIG. 5 is secured to a lower surface of printing station bar members 94 and extends in a substantially U-shaped contour to an upper surface of bar members 94. Base plate securement members 128 are threadedly secured to contact plate members 126 having contact opening 130 formed therein to receive pin members 132 of base plate bearing member 124. Base plate bearing member 124 is secured through bolts, or some like technique to a lower surface of printing station base plate member 98. In this manner, rotation of printing station frame 96 allows for rotative displacement of base plate bearing member 124 within opening 130 of base plate contact member 126 which is mounted to base plate securement member 128. Thus, printing station frame 96 is rotatively displaceable about second vertical axis 134 shown in FIG. 5 to a predetermined orientation to allow different orientations of indicia 12 on articles 14 at the discretion of the user.

Printing system 10 further includes a mechanism for releasably securing printing station mechaniam 88 in a predetermined angular orientation with respect to printing station frame 20. Printing station releasable securement mechanism 136 includes printing station bar member 94 having lug member 138 extending downward therefrom and being L-shaped in contour. As shown in FIG. 6, lug member 138 includes vertical leg 140 and horizontally extending leg 142. Vertical leg member 140 of lug member 138 is coupled in fixed securement to a respective printing station bar member 94, as is shown.

Printing station releasable securement mechanism 136 further includes roller members 144 and 146 for frictionally contacting horizontal leg member 142 of lug member 138. Roller member 146 is coupled to lower base plate member 148 through rotative displacement with respect to bar member 150 which is fixedly secured to a sidewall of lower base plate member 148.

Vertically directed bar member 152 is bolted to horizontally directed bar member 154 which is biased in a downward direction by spring member 156 as is shown in FIG. 6. Upper roller member 144 is rotatively coupled to horizontal bar member 154 and is insertable within channel 158 of horizontal leg member 142 of lug member 138. Spring member 156 is coupled on opposing ends thereof to horizontal bar member 154 and the sidewall of lower base plate member 148, as is shown. Thus, roller members 144 and 146 are forceably displaced towards each other and by insertion of roller member 144 into channel 158, printing station mechanism 88 is maintained in a fixed angular orientation however, such may be physically moved in angular displacement by a user.

Printing system 10 further may include blower mechanism 160 which may be a standard fan mechanism for drying indicia 12 applied to articles 14. Thus, as is shown in FIG. 4, blower mechanism 160 may be mounted between track members 62 to provide an upward flow of forced air to minimize the drying time of pigmentation applied to articles 14.

As can be clearly seen, in this manner, articles 14 may be mounted on a particular printing station mechanism 88 in what may be termed a loading zone. The printing station mechanism 88 may then be rotated to a printing zone beneath the indicia carriage frame 34 for printing and then rotatively displace over blower mechanism or fan 160 for drying while another article 14 simultaneously is being loaded and/or being printed. Additionally, since indicia printing carriage mechanism 32 may be in itself rotated from one side of printing frame 20 to an opposing side, one station may be used as a loading zone while two printing mechanism stations may be used as printing zones with a fourth station being utilized for drying purposes.

As is seen in FIG. 1, a plurality of indicia 12 are formed on stencil fabric member 60 of printing plate or stencil member 18. By provisions as has hereinbefore been described, printing plate or stencil member 18 may be displaced in longitudinal direction 16 at the discretion of the user to apply varying indicia 12 to a singular article 14. However, in silk screen printing, a roller is generally applied to the upper surface of fabric member 60 to pass the pigmentation composition through stencil fabric member 60. Where a plurality of indicia are formed on fabric member 60, there may be overlap of pressure and pigmentation passing through stencil member 18 in an unwanted manner In order to avoid this disadvantage, wire members 162 are mounted adjacent a lower surface of fabric member 60, as is shown in FIG. 7 and FIG. 1. Wire members 162 generally pass around each of indicia 12 and provides a spacing for the user in the vertical direction such that one indicia 12 will not be compressed onto article 14 when the user is rollingly engaging fabric member 16 in another indicia zone defined by wire members 162.

Thus, the general mechanism of maintaining adjacent zones with respect to a zone being printed out of contact with articles 14 is shown in FIG. 7. However, the concept of zonal differentiation by wire members 162 is clearly shown in FIG. 1. As is seen, wire members 162 divide stencil member 18 into a plurality of zonal sections with each zonal section surrounding a particular indicia 12 as shown. In this manner, the printing of various indicia 12 may be made independent with respect to any other indicia 12 on stencil member 18 at the discretion of the user.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A silk screen printing system for printing indicia on articles, comprising:

(a) a longitudinally extending printing frame;

(b) indicia printing carriage means for applying indicia to said articles, said indicia printing carriage means being coupled to said printing frame and linearly displaceable in said longitudinal direction; and, (c) at least one printing station means having said articles mounted thereon, said printing station means being contacted by said indicia carriage means for printing said indicia on said articles, said printing station means being rotatively coupled to said printing system frame about a first vertical axis and a second vertical axis displaced each from the other for independent rotation of said printing station means about said first and second vertical axes.

2. The silk screen printing system as recited in claim 1 where said indicia carriage means is rotatable about an axis extending in a longitudinal direction for reversibly contacting said printing station means.

3. The silk screen printing system as recited in claim 2 where said indicia carriage means is rotatable about said first vertical axis for rotation of said indicia carriage means in a substantially horizontal plane with respect to said frame.

4. The silk screen printing system as recited in claim 3 where said indicia carriage means includes:

(a) a longitudinally extending indicia carriage frame for capturing at least one printing plate member; and, (b) an indicia carriage bearing frame hingedly coupled to said indicia carriage frame about said longitudinal axis and rotatable with respect to said printing system frame about said first vertical axis.

5. The silk screen printing system as recited in claim 4 where said printing system frame includes a pair of transversely displaced track members for slidingly engaging a plurality of sliding bearing members secured to said indicia carriage bearing frame for longitudinal displacement of said indicia carriage means with respect to said printing system frame.

6. The silk screen printing system as recited in claim 4 where said indicia carriage bearing frame includes:

(a) an upper indicia carriage bearing frame plate member;

(b) a lower indicia carriage bearing frame plate member secured to said indicia carriage bearing frame; and, (c) means for rotatively actuating said upper plate member with respect to said lower plate member to allow said indicia carriage frame to rotate about said first vertical axis.

7. The silk screen printing system as recited in claim 4 where said printing station means includes:

(a) a printing station frame;

(b) a printing station baseplate member located internal said printing station frame, said articles being mounted on said printing station baseplate member; and, (c) means for releasably securing said articles to said printing station baseplate member and said printing station frame.

8. The silk screen printing system as recited in claim 7, where said printing station baseplate member is rotatively displaceable about said second vertical axis.

9. The silk screen printing system as recited in claim 8 where said means for releasably securing said articles includes at least two frictional bar members threadedly secured to said printing station frame for being displaced into force contact with said printing station baseplate member, said article being captured between said frictional bar members and said printing station baseplate member.

10. The silk screen printing system as recited in claim 7 where said printing station frame is hingedly secured to said printing frame for rotatively displacing said printing station frame with respect to said printing station baseplate member.

11. The silk screen printing system as recited in claim 7 including means for releasably securing said printing station means in a predetermined angular orientation with respect to said printing station frame.

12. The silk screen printing system as recited in claim 11 where said means for releasable securement includes:

(a) at least one printing station bar member rotatively coupled to said printing station baseplate member;

(b) a lug member secured to said printing station bar member; and, (c) means for engaging said lug member between a pair of roller members secured to said printing system frame.

13. The silk screen printing system as recited in claim 12 where said means for engaging said lug member includes means for resiliently capturing said lug member between said roller members.

14. The silk screen printing system as recited in claim 13 where said means for engaging said lug member includes said rollers being located on opposing surfaces of said lug member, one of said lug member surfaces having a channel formed therein for receipt of at least one of said roller members.

15. The silk screen printing system as recited in claim 1 including a plurality of printing station means rotatively coupled to said longitudinally extending printing system frame.

16. The silk screen printing system as recited in claim 15 where each of said plurality of printing station means is fixedly secured to a central printing system frame bearing member, said bearing member being rotatively coupled to said printing system frame.

17. The silk screen printing system as recited in claim 1 including blower means coupled to said printing system frame for drying pigmentation applied to said articles.

18. The silk screen printing system as recited in claim 1 including indicia stencil means mounted in said indicia carriage means, said indicia stencil means including a plurality of indicia zones, said stencil means including means for maintaining adjacent zones with respect to a zone being printed out of contact with said articles.

* * * * *